United States Patent [19]

Sollanek

[11] 3,930,710

[45] Jan. 6, 1976

[54] CONNECTOR BACKSHELL ADAPTER AND METHOD OF USING SAME

[75] Inventor: Richard Sollanek, Ellicott, Md.

[73] Assignee: The United States of America as represented by the Secretary of the Navy, Washington, D.C.

[22] Filed: Sept. 23, 1974

[21] Appl. No.: 508,491

[52] U.S. Cl. ..... 339/143 R; 339/84; 339/136 C

[51] Int. Cl.[2] ..... H01R 13/46

[58] Field of Search.... 339/143 R, 5, 84, 86, 113 L, 339/136 C, 89 M, 91 R

[56] References Cited

UNITED STATES PATENTS

| | | | |
|---|---|---|---|
| 923,284 | 6/1909 | Lowe | 339/84 |
| 1,334,709 | 3/1920 | Morey | 339/86 |
| 2,546,854 | 3/1951 | Foster et al. | 339/113 L |
| 3,659,251 | 4/1972 | Fish | 339/143 R |

FOREIGN PATENTS OR APPLICATIONS

| | | | |
|---|---|---|---|
| 723,590 | 2/1955 | United Kingdom | 339/136 C |

*Primary Examiner*—Roy Lake
*Assistant Examiner*—DeWalden W. Jones
*Attorney, Agent, or Firm*—R. S. Sciascia; J. A. Cooke

[57] ABSTRACT

An adapter device for use with cable connectors. The adapter device comprises an elongated tubular sleeve having means for engaging cable connector backshell and mating rings and an adapter ring slidably engaging the adapter sleeve. The adapter ring comprises at least two longitudinally adjacent segments, a first segment having a cross-sectional diameter slightly larger than the cross-sectional diameter of the adapter sleeve, and a second segment having a cross-sectional diameter slightly larger than the cross-sectional diameter of the connector mating ring. A cable is attached to the connector backshell and extended through the adapter sleeve to the connector mating ring. The backshell and mating ring are attached to the adapter sleeve and the adapter ring is secured to the mating ring. The adapter device can be coded for identification.

6 Claims, 3 Drawing Figures

CONNECTOR BACKSHELL ADAPTER AND METHOD OF USING SAME

BACKGROUND OF THE INVENTION

The present invention relates in general to cable connecting devices and more particularly to an adapter for use with cable connectors.

Devices for connecting multi-element cables to equipment such as electronic systems are well known. Examples of electronic connectors are shown in Johnson et al U.S. Pat. No. 3,329,925 and Brancaleone, U.S. Pat. No. 3,678,445.

Secure attachment is required for all cable connector devices. Reeder, U.S. Pat. No. 3,261,844 is an example of a cable connected designed to provide secure attachment.

In addition to providing secure cable attachment, a connector should protect the cable from undue strain and external influences. Examples of connectors designed to provide such protection are Rohrig, U.S. Pat. No. 3,803,529 and Fish, U.S. Pat. No. 3,659,251. The common spark plug shield is another example of connectors designed to provide protection.

As technology, and especially electronic technology becomes increasingly couplex, the demands placed on all system components increases correspondingly. Cable connectors are no exception to these increasing demands. Although often given only slight importance when an entire system is considered, the connectors perform vital functions. In addition to the above-discussed functions of simply connecting and protecting, connectors provide a convenient means for identifying the various cable or mechanical conduits in the system. As overall systems become more complex, cable identification becomes increasingly important.

The most convenient methods of identifying cables is by color codes and/or identity numbers. Cable connectors presently known to applicant cannot be easily color coded or etched with identifying numbers. This drawback results because of the size of, or materials used in, presently known connectors.

Connection or removal of cables using presently known cable connectors usually requires tools such as special wrenches or pliers. Thus, in addition to the above-discussed drawbacks, installation and removal of presently known cable connectors is inhibited by the requirement of special tools. Furthermore, such special equipment is expensive, wears out quickly and is easily lost.

The drawbacks inherent in presently known cable connectors are magnified in the complex electronic systems found aboard naval vessels. The plethora of electronic connections, often made to electronic equipment placed in inaccessible areas, strikingly manifests the need for easily identified, simply operated and reliable cable connectors.

The cable connector adapter device of the present invention overcomes the above-discussed drawbacks by providing an easily coded cable connecting device which provides protection for cable connections while allowing hand installation and/or removal of cable connections.

SUMMARY OF THE INVENTION

Briefly, the present invention relates to an adapter device used in conjunction with a multi-element cable connector having a backshell and a mating ring. The adapter device comprises an elongated tubular adapter sleeve having external screw threads on one end for engaging the connector backshell and internal threads on the other end for engaging the connector mating ring, and an adapter having at least two longitudinally adjacent segments slidably engaging the adapter sleeve. The adapter ring comprises a first segment having a cross-sectional diameter slightly larger than the cross-sectional diameter of the adapter sleeve to allow a sliding fit between these two elements, and a second segment having a cross-sectional diameter large enough to allow sliding engagement between the adapter and connector mating rings, and a plurality of tapped holes positioned about the circumference of the second segment. Set screws positioned in the tapped holes provide means for securing the adapter ring to the connector mating ring. Knurling is positioned on the adapter ring first segment.

Coding information is provided by color coding the adapter sleeve and/or adapter ring and/or information etched or engraved onto the adapter sleeve.

The adapter sleeve and adapter ring provide surfaces to grip the connector device, and due to the mechanical advantage provided by the device, only hand grip pressure is required to turn the connector and therefore disengage or engage the connection between the connector mating ring and corresponding system equipment. Thus, the device allows expeditious and easy connection and/or removal of cables, such as multi-element electronic cables without using special tools. The large surface area provided by the adapter sleeve also facilitates hand gripping of the adapter device.

The adapter device may be used in conjunction with a conventional cable connector having a backshell and a mating ring by first attaching the connector backshell and the adapter sleeve, then attaching a cable thereto. The adapter ring is placed onto the adapter sleeve, and the connector mating ring is attached to the cable. The mating ring is attached to the adapter sleeve and the adapter ring is affixed to the mating ring by the set-screws. The cable is then easily connected and/or removed by simple hand operations.

A broad object of the present invention is to improve cable connectors.

Another object of the present invention is to provide a cable connector which can be removed or installed without using special tools.

Still another object of the present invention is to provide a cable connector which protects an installed cable from strain.

Yet another object of the present invention is to provide a cable connector which can be easily coded for identification.

Still another object of the present invention is to provide a method of installing and removing a cable without using tools.

BRIEF DESCRIPTION OF THE DRAWINGS

A more complete appreciation of the invention and many of the attendant advantages thereof will be readily appreciated as the same becomes better understood by references to the following detailed description when considered in connection with the accompanying drawings wherein.

DETAILED DESCRIPTION OF THE PREFERRED EMBODIMENTS

Figure 2:
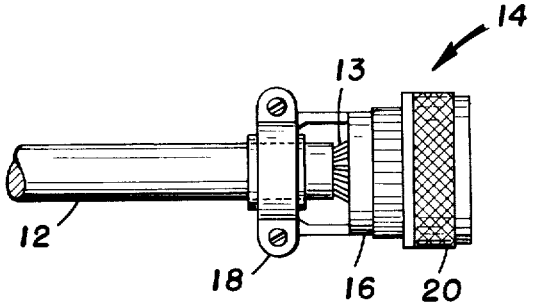
FIG. 2 shows a commercial cable connector.

Shown in the drawings is an adapter device 10 for attaching a cable such as multi-element cable 12 to various forms of mechanical or electrical equipment (not shown). The adapter 10 is used in conjunction with a conventional connector 14 comprising a backshell 16 having a cable clamp 18 and internal threads (not shown) and a mating ring 20 having knurling and external threads thereon (not shown). Such a connector is shown in FIG. 2. along with a multielement cable 12 having a plurality of elements 13.

Elements of cable 12 are conventionally mounted on mating ring 20 and backshell 16 is attached to the cable 12 in the conventional manner using cable clamp 18.

Figure 1:
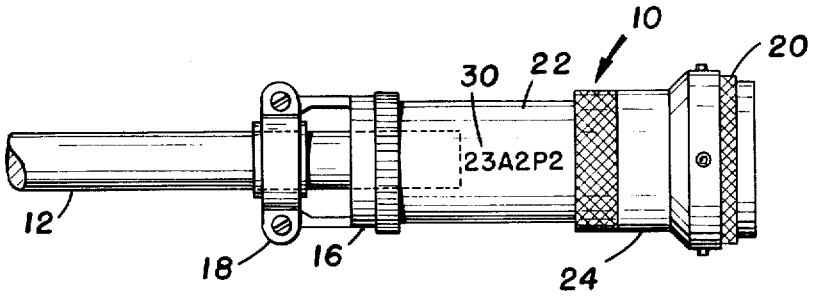
FIG. 1 shows the connector device of the present invention engaging a conventional connector and cable.

As shown in FIG. 1, the adapter device 10 comprises an elongated tubular adapter sleeve 22 and a tubular adapter ring 24 slidingly positioned thereon.

Figure 3:
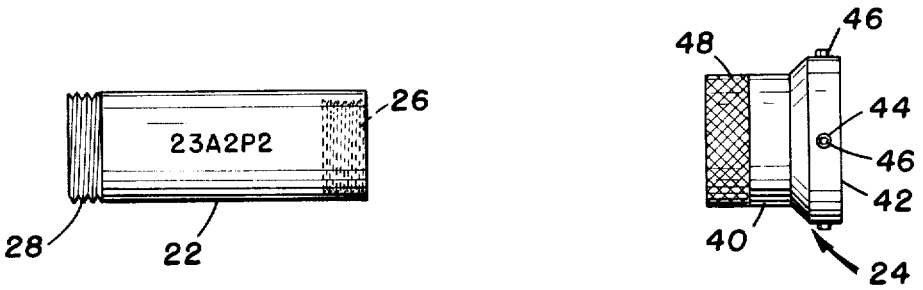
FIG. 3 shows component parts of the adapter device of the present invention.

As shown in FIG. 3, the adapter sleeve 22 is tubular in shape and has internal screw threads 26 on one end for threadably engaging connector mating ring 20 and external screw threads 28 on the other end for threadably engaging connector backshell 16. The threads 26 and 28 may be of any type corresponding to the threads used for connector 14 and may be on either surface of sleeve 22 as desired.

Adapter sleeve 22 may be aluminum or any other suitable material. Sleeve 22 may be anodized, color coded and/or have identifying markings such as code numerals 30 etched or engraved thereon. Simple color coding and/or identifying numerals 30 obviously expedites the cable connection process. Therefore, because it provides a convenient means for effecting such classification, the sleeve 22 provides important advantages to the present invention.

The sleeve 22 also provides a surface which is easily handheld during connection or removal of cable 12. The additional gripping surface allows easy handling of the connector even in inaccessible areas. Without the additional gripping surface, a special wrench must be used in the cable connection and/or removal process. Use of wrenches or pliers is often difficult or impossible in the small areas often found around electronic equipment. The mechanical advantage provided by sleeve 22 is therefore an important result of the present invention.

After cable 12 is connected to corresponding equipment, sleeve 22 serves as a support for the cable. By supporting cable 12 for some length thereof adjacent mating ring 20, strain on cable 12 is reduced. Reduced strain on wires or pins in cable 12 obviously increases reliability of the connection.

As shown in FIG. 3, tubular adapter ring 24 comprises two longitudinally adjacent segments, a first segment 40 and a second segment 42. First segment 40 has a cross-sectional diameter slightly larger than the cross-sectional diameter of adapter sleeve 22 to allow sliding engagement between the adapter sleeve 22 and adapter ring 24. Second segment 42 has a cross-sectional diameter slightly larger than the cross-sectional diameter of the connector mating ring 20 to allow sliding engagement between the adapter ring 24 and connector mating ring 14. A plurality of tapped holes 44 are positioned around the circumference of second segment 42 and have set screws 46 therein to provide locking engagement between adapter ring 24 and connector mating ring 20. Knurling 48 is positioned on adapter ring first segment 40 to allow easy gripping of the ring 24 during connection and/or removal operations.

As with the adapter sleeve 22, the adapter ring 24 may be any suitable material such as aluminum. The ring 24 also may be anodized, color coded and/or have identifying markings etched or engraved thereon for convenient classification.

The length and size of adapter ring 24 provides mechanical advantage for moving connector mating ring 20. The additional gripping surface provided by first segment 40 and the traction provided by knurling 48 also increases, the ease with which connector mating ring 20 is moved. Therefore because of the mechanical advantage provided by adapter ring 20 and the gripping surface provided by sleeve 22, no wrenches or other gripping tools are required to move connector mating ring 20. Thus, the additional mechanical advantage provided by adapter ring 24 is an important feature of the present invention.

Cable 12 is connected to corresponding electronic or mechanical equipment using adapter device 10 in conjunction with a conventional connector 14. An example of the method used for such connection will now be given. Connector backshell 16 is threadably engaged with adapter sleeve external screw threads 28 and cable 12 is inserted through the combination and secured thereto by clamp 18. Adapter ring 24 is slidably engaged with sleeve 22 and connector mating ring 20 is conventionally mounted onto the wire and/or pin elements of cable 12. Adapter sleeve 22 is threadably engaged with connector mating ring 20 and adapter ring 24 is positioned onto mating ring 20 by set screws 46. The cable 12 is then connected to the appropriate equipment by simply aligning the cable elements, setting the mating ring and turning the adapter ring 24 until a secure fit is obtained. Removal of cable 12 is equally simple and requires only that pressure normally exerted by a hand grip on adapter ring 24 to loosen mating ring 20 and thus disconnect cable 12 from the electronic equipment.

Alternative embodiments of the adapter device 10 may include a wide variety of cross-sectional shapes and diameters of both sleeve 22 and ring 24. The cross-sectional shapes and diameters may be changed to facilitate easy adaptation of device 10 to connector 14. For example, adapter ring second segment 46 may have a cross-sectional diameter slightly smaller than the cross-sectional diameter of connector mating ring 20.

Other forms of device 10 can be used to attach conduits or other forms of mechanical "cables" to mechanical equipment.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. In combination with an adapter device for use with an electrical connector, having a backshell element with cable clamping means detachably connected by threads means to a frontal cable connector with a connector mating ring, designed to be used with multi-element cables, wherein:

a tubular adapter is threadably formed at its opposing ends having external threads at one end and having internal threads at the other end to match the thread means of the electrical connectors backshell and mating rings, and is interposed between and connected by the tubular screw threads to the backshell and mating rings, so as to provide increased mechanical support and strain-relief to the multi-element cable which is held by the cable clamping means and which passes through the tubular adapter to connections on the connector and to aid in connection of large multi-element cable assemblies, the improvement which comprises a tubular adapter ring, slidably positioned about the tubular adapter, said adapter ring comprising at least two longitudinally adjacent, segments, a first segment having a cross-sectional diameter slightly larger than the cross sectional diameter of the tubular adapter and having a marginal region of its surface scribed with knurling; and a second segment having a cross-sectional diameter large enough to allow sliding engagement between the tubular adapter ring and the cable connector ring and having a plurality of tapped set screws circumferentially positioned around the adapter ring to provide locking engagement between the adapter ring the connector ring.

2. The adapter device of claim 1 wherein said device is anodized.

3. The adapter device of claim 1 wherein said device is color coded.

4. The adapter device of claim 1 including an identification code placed thereon.

5. A method of attaching cables to equipment comprising the steps of:

interconnecting a cable connector backshell to an adapter device sleeve;

inserting a cable through the sleeve;

securing said cable to said backshell;

sliding an adapter device ring onto said sleeve;

mounting said cable onto a connector mating ring;

engaging said adapter device sleeve with said connector mating ring;

setting said adapter ring in place on said mounting ring; and connecting the cable to the equipment.

6. The method of attaching cables to equipment of claim 5 wherein the step of connecting the cable to the equipment includes turning the adapter ring to threadably engage said mounting ring to the equipment.

* * * * *